US008018381B2

(12) United States Patent
Mori

(10) Patent No.: US 8,018,381 B2
(45) Date of Patent: Sep. 13, 2011

(54) ANTENNA APPARATUS

(75) Inventor: Nobuyuki Mori, Tokyo (JP)

(73) Assignee: Sony Corporation (JP)

( * ) Notice: Subject to any disclaimer, the term of this patent is extended or adjusted under 35 U.S.C. 154(b) by 301 days.

(21) Appl. No.: 12/288,040

(22) Filed: Oct. 16, 2008

(65) Prior Publication Data

US 2009/0109092 A1 Apr. 30, 2009

(30) Foreign Application Priority Data

Oct. 25, 2007 (JP) ..... P2007-278099

(51) Int. Cl.
*H01Q 3/02* (2006.01)
*H01Q 3/12* (2006.01)

(52) U.S. Cl. ..... 342/374

(58) Field of Classification Search ..... 342/374
See application file for complete search history.

(56) References Cited

U.S. PATENT DOCUMENTS

| | | | | |
|---|---|---|---|---|
| 5,912,646 | A | 6/1999 | Seki et al. | |
| 6,362,790 | B1 * | 3/2002 | Proctor et al. | 343/702 |
| 6,448,930 | B1 * | 9/2002 | Judd | 343/700 MS |
| 6,480,157 | B1 * | 11/2002 | Palmer et al. | 343/700 MS |
| 6,515,635 | B2 * | 2/2003 | Chiang et al. | 343/834 |
| 6,650,294 | B2 * | 11/2003 | Ying et al. | 343/700 MS |
| 6,664,932 | B2 * | 12/2003 | Sabet et al. | 343/770 |
| 6,757,553 | B1 * | 6/2004 | English | 455/562.1 |
| 7,358,912 | B1 * | 4/2008 | Kish et al. | 343/725 |
| 7,643,794 | B2 * | 1/2010 | Ofek et al. | 455/25 |
| 7,646,343 | B2 * | 1/2010 | Shtrom et al. | 343/700 MS |
| 2004/0056812 | A1 * | 3/2004 | Sabet et al. | 343/725 |
| 2007/0117514 | A1 * | 5/2007 | Gainey et al. | 455/63.4 |
| 2008/0139136 | A1 * | 6/2008 | Shtrom et al. | 455/101 |
| 2008/0246663 | A1 * | 10/2008 | Fox | 342/373 |
| 2009/0143038 | A1 * | 6/2009 | Saito | 455/272 |

FOREIGN PATENT DOCUMENTS

| | | | |
|---|---|---|---|
| JP | 1-151325 | A | 6/1989 |
| JP | 09-284045 | A | 10/1997 |
| JP | 11-101835 | A | 4/1999 |
| JP | 2004-111140 | A | 4/2004 |
| JP | 2006-157484 | A | 6/2006 |
| JP | 2007-214927 | A | 8/2007 |
| JP | 2007-251677 | A | 9/2007 |
| JP | 2007-258174 | A | 10/2007 |

OTHER PUBLICATIONS

Valerie Illingworth, "A Dictionary of Computing", 1997, New York Oxford University Press.*

* cited by examiner

*Primary Examiner* — Thomas H Tarcza
*Assistant Examiner* — Frank McGue
(74) *Attorney, Agent, or Firm* — Lerner, David, Littenberg, Krumholz & Mentlik, LLP

(57) ABSTRACT

An antenna apparatus is disclosed. The antenna apparatus has a first antenna, a second antenna, and a third antenna which have different directivity directions each other and are switched for a desired directivity direction. The first antenna is disposed on a substrate which is in parallel therewith. The second antenna is disposed on one principal surface of the substrate which is nearly perpendicular thereto. The third antenna is disposed on the other principal surface of the substrate which is nearly perpendicular thereto.

4 Claims, 11 Drawing Sheets

ANTENNA APPARATUS

CROSS REFERENCES TO RELATED APPLICATIONS

The present application claims priority from Japanese Patent Application No. JP 2007-278099, filed in the Japanese Patent Office on Oct. 25, 2007, the entire content of which is incorporated herein by reference.

BACKGROUND OF THE INVENTION

1. Field of the Invention

The present invention relates to an antenna apparatus, in particular, to an antenna apparatus on which a plurality of antennas are mounted and that can switch from one directivity direction to another for radio communication.

2. Description of the Related Art

In radio systems such as wireless local area network (LAN), for higher communication quality, a plurality of antennas are mounted and their directivity directions are switched. By optimally controlling the plurality of antennas, deterioration of transmission quality, for example, due to multipath fading can be suppressed. In addition, such systems can have resistance against disturbance from other radio devices and narrow the range in which the systems disturb other radio devices. For example, Patent Document 1, disclosed as Japanese Patent Application Laid-Open No. 2007-251677, describes a radio communication apparatus on which a plurality of antennas having different directivities are mounted.

FIG. 1 shows an exemplary structure of an antenna apparatus having a plurality of antennas as a related art reference. The antenna apparatus has a substrate 101 composed of a wireless module and so forth, a radio circuit section 102 disposed on the substrate 101, six antennas 103*a*, 103*b*, 103*c*, 103*d*, 103*e*, and 103*f* (hereinafter, they are generally designated by antennas 103 unless otherwise specified). This antenna apparatus is used in such a manner that the principal surfaces lay down.

As shown in FIG. 1, the six antennas 103 are disposed in such a manner that they form a circumference of a circle on a horizontal surface of one principal surface of the substrate board 101. Since the antennas 103 are nearly equiangularly disposed such that they divide the circumference of the circuit into six sectors, the antennas 103 can have directivities of different directions from each other.

In the radio communication using such an antenna apparatus, an optimum antenna 103 is selected from the plurality of antennas 103 corresponding to the exiting communication environment. Through the selected antenna 103, radio communication is performed. To reduce the influence of overlapping of adjacent antennas 103, it is necessary to isolate the selected antenna 103 from the adjacent antennas 103 for a predetermined amount. Thus, the spaces of the antennas 103 are secured corresponding to the communication frequencies of the radio system.

However, if the antennas 103 are disposed on the same plane as shown in FIG. 1, it is necessary to secure the spaces of the antennas 103 for their isolation. Thus, the overall structure of the antenna apparatus becomes large. This is a cause that prevents a product having the antenna apparatus from being downsized.

When this antenna apparatus is mounted on a rectangular-parallelepiped-shaped electronic device, if it is designed to lay down where the largest side of the six sides of the rectangular parallelepiped body is the bottom of the electronic device, it seems that the plurality of antennas 103 can be relatively easily mounted. In contrast, if the electronic device is designed to stand upright where the smallest side of the six sides of the rectangular parallelepiped body is the bottom of the electronic device, since the bottom area is not large, it becomes difficult to dispose the antennas 103. Thus, the shape of the product is restricted.

In addition, in the radio system that switches from one directivity to another of the plurality of antennas 103, as the number of antennas 103 is increased, the performance can be improved. However, if the number of antennas 103 is increased, the circumference of the circle in which the antennas 103 are disposed is increased. Thus, the space in which the antennas 103 are disposed is increased. As a result, since there is a tradeoff between the performance of the antennas and the area in which they are disposed, an antenna apparatus that allows the plurality of antennas 103 can be disposed in a saved space is being desired.

To solve such a problem, Patent Document 2, disclosed as Japanese Patent No. 3456507, describes a selector antenna that has a plurality of antenna elements disposed vertically, not horizontally and that allows the outer diameter (bottom area) of the sector antenna to be decreased without changing of directivity characteristics.

SUMMARY OF THE INVENTION

However, in the related art reference as Patent Document 2 above, since the plurality of antenna elements are disposed at different heights, the vertical length of the sector antenna increases corresponding to the number of antenna elements disposed vertically. Thus, the overall size of the sector antenna is not decreased. In addition, a problem of which the solid arrangement of the antenna elements becomes complicated arises.

In view of the foregoing, it would be desirable to provide an antenna apparatus that secures isolation between adjacent any two of the plurality of antennas and that can be downsized in a simple structure.

According to an embodiment of the present invention, there is provided an antenna apparatus having a first antenna, a second antenna, and a third antenna which have different directivity directions each other and which are switched for a desired directivity direction. The first antenna is disposed on a substrate which is in parallel therewith. The second antenna is disposed on one principal surface of the substrate which is nearly perpendicular thereto. The third antenna is disposed on the other principal surface of the substrate which is nearly perpendicular thereto.

According to an embodiment of the present invention, by combining gain patterns of adjacent two antennas of the first antenna, the second antenna, and the third antenna, it is preferred that a fourth antenna pattern be obtained in a direction different from a first antenna gain pattern obtained from the first antenna, a second antenna gain pattern obtained from the second antenna, and a third antenna gain pattern obtained from the third antenna.

According to an embodiment of the present invention, it is preferred that a connector socket be mounted on the substrate, pin headers be mounted on the second antenna and the third antenna, and by fitting the pin headers to the connector socket, the second antenna and the third antenna be nearly perpendicularly connected to the substrate.

According to an embodiment of the present invention, it is preferred that the pin header have at least three pins and the at least three pins be fit to the connector socket.

According to an embodiment of the present invention, the first antenna is disposed on the substrate which is in parallel therewith and the second antenna and the third antenna are disposed on the substrate which is nearly perpendicular thereto. Thus, while isolation of the first antenna, the second antenna, and the third antenna is kept, they can be disposed in a saved space.

According to embodiments of the present invention, while isolation of a plurality of antennas is secured, they can be disposed in a simple structure and in a saved space. As a result, downsizing of the antenna apparatus can be accomplished.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENTS

Next, with reference to the accompanying drawings, embodiments of the present invention will be described.

First Embodiment

An antenna apparatus according to a first embodiment of the present invention can be applied to a location-free visual-audio system that has place shift function, this system being, for example, called LocationFree (registered trademark of Sony Corporation) with which the user can watch and listen to content such as television programs wherever he or she is. The minimum structural components of the place shift visual-audio system are a base station that is a content transmitting apparatus and a receiving apparatus (also referred to as a location free player or a client) that provide picture and sound to the user.

Figure 1:
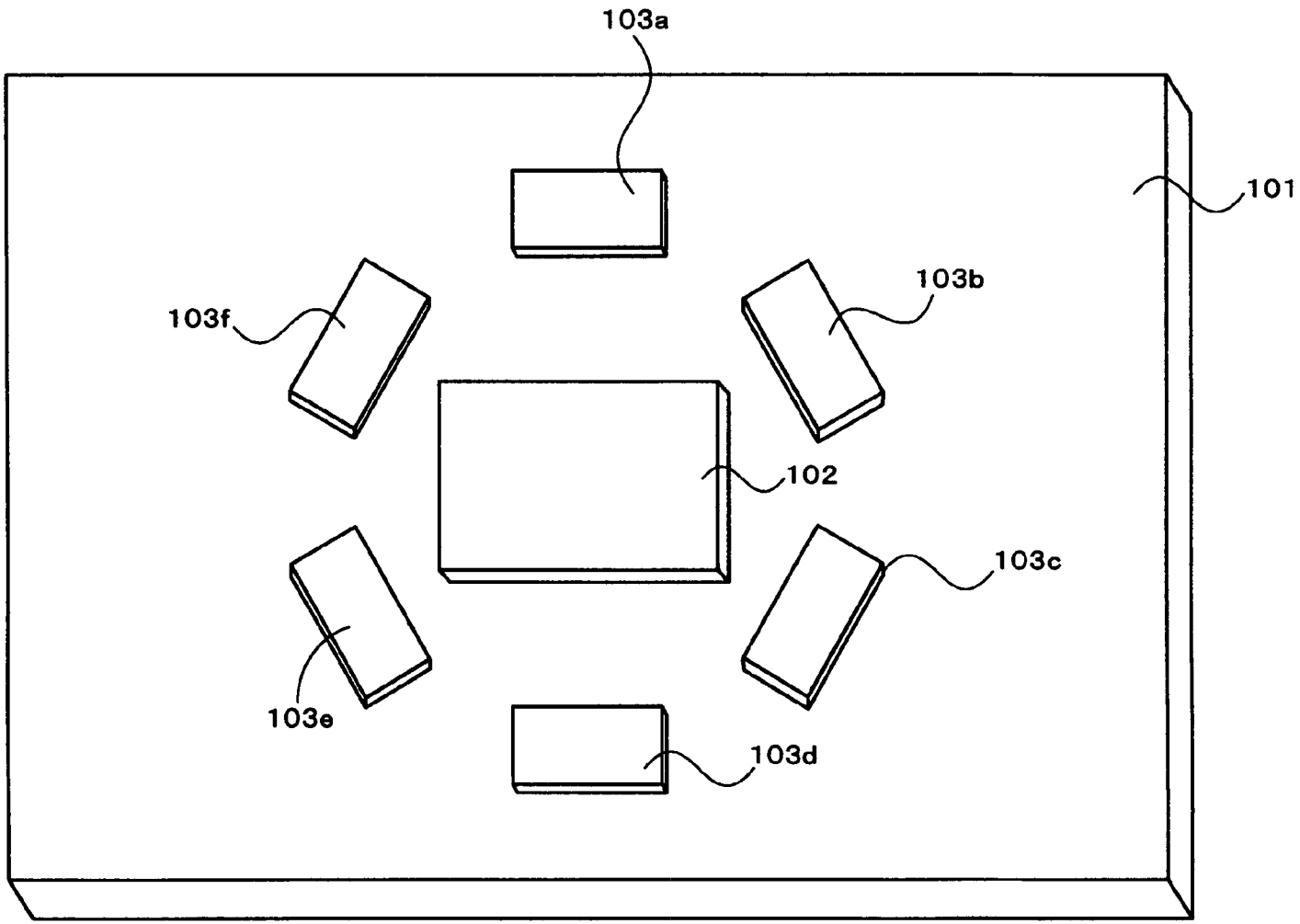
FIG. 1 is a plan view showing an exemplary structure of an antenna apparatus having a plurality of antennas as a related art reference.
Figure 2:
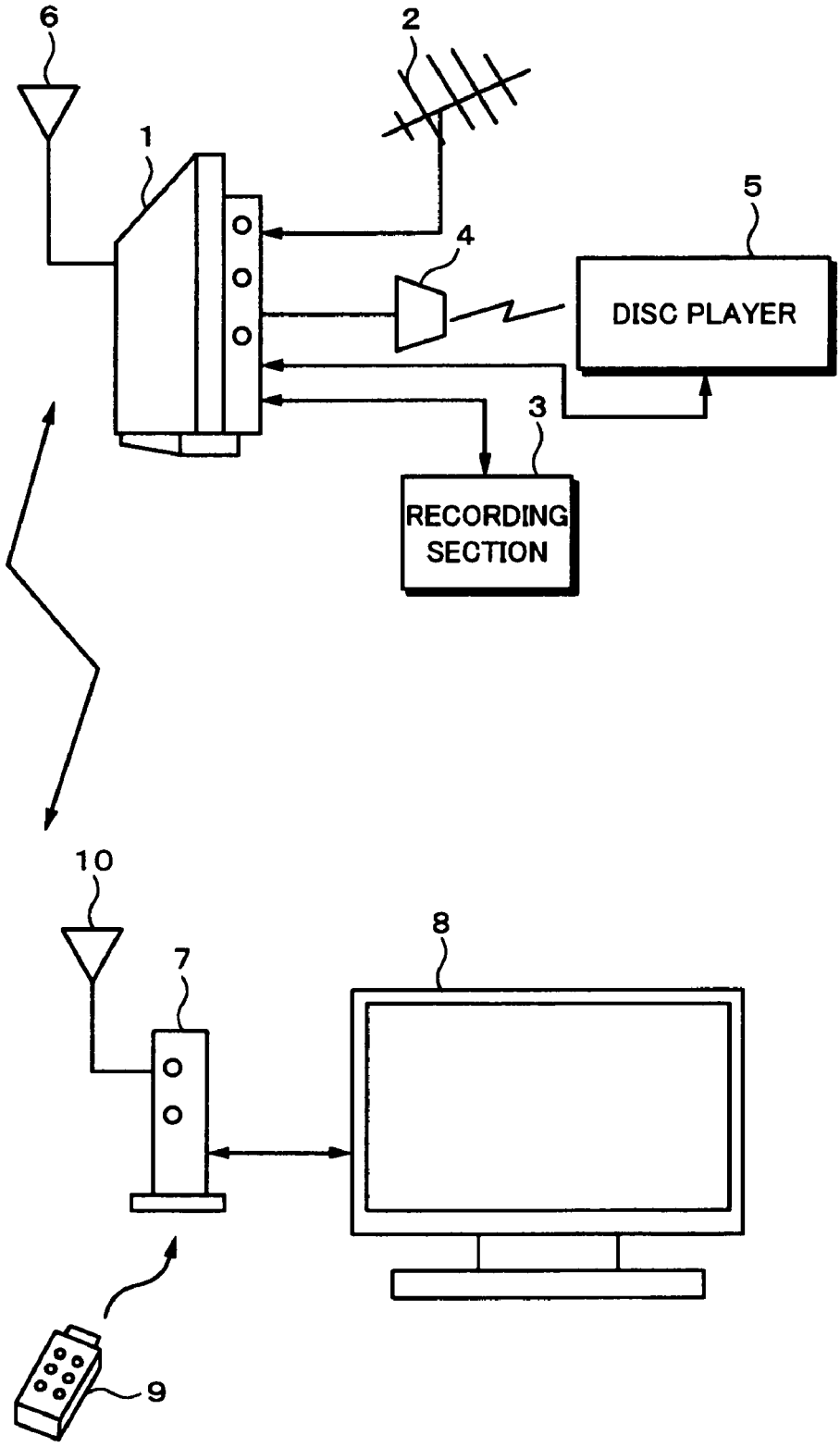
FIG. 2 is a schematic diagram showing the overall structure of a wireless LAN system to which an antenna apparatus according to a first embodiment of the present invention is applicable.

First, with reference to FIG. 2, the structure of a content transmitting and receiving system using wireless LAN will be briefly described. Connected to a base station 1 that is the content transmitting apparatus is a television antenna 2. Thus, the base station 1 can receive television broadcast content (eg, analog television broadcast content). In addition, the base station 1 may receive television broadcast content of satellite digital broadcast, terrestrial digital broadcast, cable television, Internet television, and so forth.

Moreover, connected to the base station 1 is a disc player 5 such as a digital versatile disc (DVD) player or a Blu-ray Disc (BD) player. The disc player 5 can output a standard definition (SD) picture or a high definition (HD) picture recorded on a disc to the base station 1 according to an external control command.

Channel switching of broadcast programs that the base station 1 transmits and the operation of the disc player 5 can be remotely controlled by the receiving apparatus (location free player or client). For example, an AV mouse 4 is connected to the base station 1 and the operation of the disc player 5 is remotely controlled through the AV mouse 4 by the receiving apparatus.

The base station 1 has an antenna apparatus 6. The antenna apparatus 6 of the base station 1 and an antenna apparatus 10 of a television box 7 form wireless LAN. Broadcast content received by the base station 1 and compression-encoded data of reproduced picture and so forth of the disc player 5 are transmitted to the television box 7 through the wireless LAN. Data are packetized and transmitted. The wireless LAN systems are based on three IEEE 802.11b/g/a standards.

In the antenna apparatus 6 and 10, a sector antenna is composed of a plurality of directivity antennas. For a directivity of a desired direction, one of these directivity antennas is selected. The structure of the antenna apparatus 6 and 10 will be described later.

Connected to the wireless LAN is the television box 7, which is a content receiving apparatus. The television box 7 decodes data of broadcast content received through the wireless LAN and outputs the decoded data as an analog video audio signal. The analog video audio signal is supplied to a video input terminal of a display 8 (eg, a television receiver). With the display 8, the user can watch and listen to a television broadcast program transmitted from the base station 1.

In addition, the television box 7 decodes reproduced picture data of the disc player 5 received through the wireless LAN and outputs the decoded data as a digital video audio signal. The digital video audio signal is supplied to the input terminal of the display 8. With the display 8, the user can watch and listen to an HD picture and so forth transmitted from the base station 1.

A remote control commander 9 can remotely control the television box 7.

With the display 8, the user can watch and listen to broadcast content transmitted from the base station 1. In addition, with the function of the television box 7, the display 8, and the commander 9, data can be set for the base station 1 and the disc player 5 and so forth connected thereto and they can be remotely controlled.

When the television antenna 2 and the disc player 5 are to the base station 1 in such a manner, the user can watch and listen to a live television broadcast program or a reproduced picture of the disc player 5 through the wireless LAN in any room of the house. In the following description, in the wireless LAN system, a side such as the base station 1 that transmits data of reproduced picture and so forth is sometimes referred to as a radio base station. On the other hand, a side such as the television box 7 that receives data of reproduced picture and so forth is sometimes referred to as a radio terminal.

Figure 3:
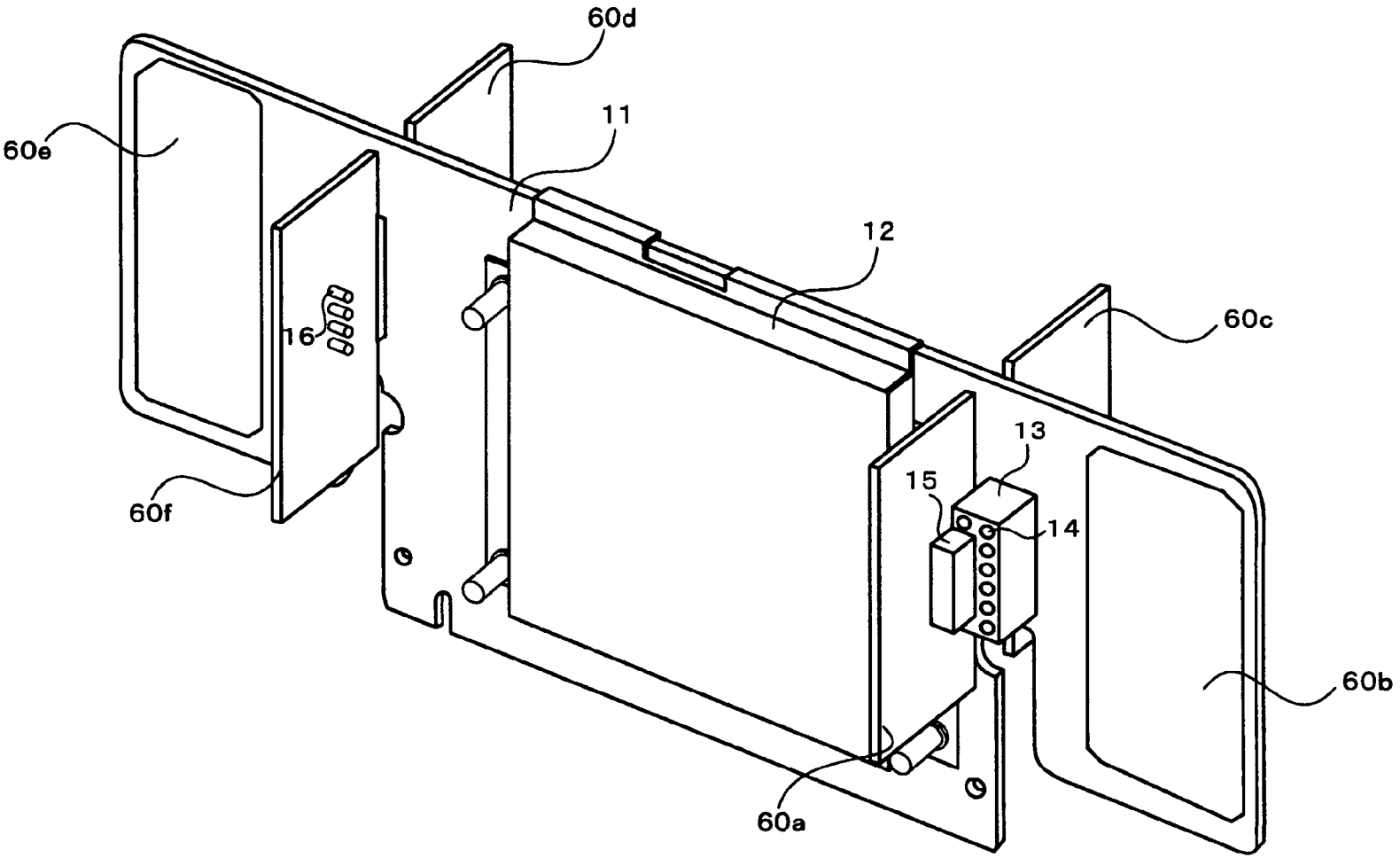
FIG. 3 is a perspective view showing an exemplary structure of an antenna apparatus of a radio base station according to the first embodiment of the present invention.

Next, with reference to FIG. 3, an exemplary structure of the antenna apparatus 6 disposed on the base station 1 will be described. FIG. 3 is a perspective view showing an exemplary structure of the antenna apparatus 6. The antenna apparatus 6 is mainly composed of a substrate 11, a circuit section 12, antennas 60*b* and 60*e* as a first antenna group, antennas 60*a* and 60*f* as a second antenna group, and antennas 60*c* and 60*d* as a third antenna group. In the following description, the antennas 60*a*, 60*b*, 60*c*, 60*d*, 60*e*, and 60*f* are generally represented by antennas 60, unless otherwise specified. The antenna apparatus is used in the state that the principal surfaces of the substrate 11 stand upright.

The substrate 11 is composed, for example, of a wireless module. The substrate 11 is a multi-layered substrate composed, for example, of four layers. The inner two layers are used as a power supply layer and a ground layer. The outer two layers are used as a component mounting layer and a circuit wiring layer. These layers are insulated by bonding agent or the like. These layer are connected, for example, by through-holes formed in the substrate 11.

The circuit section 12 is disposed, for example, nearly at a center portion of one principal surface on the substrate 11. The circuit section 12 includes various types of circuits that select an optimum one from the plurality of antennas 60 for radio communication. A specific circuit structure of the circuit section 12 will be described later.

The antennas 60 are planar printed antennas as wiring patterns, for example, formed on the front surface of the substrate. The antennas 60 are, for example, dipole antennas and can handle radio signals of 2.4 GHz and 5 GHz. In the first embodiment, an example of which six antennas 60 are disposed is described. However, it is appreciated that the number of antennas 60 is not limited to any specific number.

As shown in FIG. 3, the antennas 60*b* and 60*e* as the first antenna group are disposed on both ends of principal surfaces of the substrate 11 in parallel with the substrate 11. The antennas 60*b* and 60*e* are nearly symmetrical with respect to the circuit section 12.

The antennas 60*a*, 60*c*, 60*d*, and 60*f* are disposed nearly perpendicular to the substrate 11. The antennas 60*a* and 60*f* as the second antenna group are disposed on one principal surface of the substrate 11. The antennas 60*c* and 60*d* as the third antenna group are disposed on the other principal surface of the substrate 11. The antennas 60*a* and 60*c* are disposed on the principal surfaces of the substrate 11 between the circuit section 12 and the antenna 60*b*, whereas the antennas 60*d* and 60*f* are disposed on the principal surfaces of the substrate 11 between the circuit section 12 and the antenna 60*e*.

Thus, since the second antenna group (antennas 60*a* and 60*f*) and the third antenna group (antennas 60*c* and 60*d*) are adjacent to and perpendicular to the first antenna group (antennas 60*b* and 60*e*), respectively, the plurality of antennas can be disposed in a saved space. As a result, the horizontal surface (the horizontal surface of which the principal surfaces of the substrate 11 stand upright) can be small. Thus, downsizing of the antenna apparatus 6 can be accomplished.

These antennas 60 have directivity directions that are different from each other. The directivity direction of each of the antennas 60 is a direction in which a radio signal is transmitted by the radio base station and received by the antenna apparatus 6.

In addition, these antennas 60 can have sufficient isolation therebetween. Since the antenna 60*b* is perpendicular to each of the antennas 60*a* and 60*c*, even if they are disposed close to each other, they can have sufficient isolation therebetween. Likewise, since the antenna 60*e* is perpendicular to each of the antennas 60*d* and 60*f*, even if they are disposed close to each other, they can have sufficient isolation therebetween.

Although the antennas 60*a* and 60*c* are disposed close to each other, they are interposed through the substrate 11, the ground layer of the substrate 11 provides a shielding effect against electromagnetic waves, resulting in providing sufficient isolation. Likewise, since the antennas 60*d* and 60*f* are interposed through the substrate 11, they can have sufficient isolation therebetween.

Since antennas 60*a* and 60*f* are spaced to some extent, they can have isolation therebetween. Likewise, since the antennas 60*c* and 60*d* are spaced to some extent, they can have isolation therebetween.

The antennas 60*a*, 60*c*, 60*d*, and 60*f* are disposed nearly perpendicular to the substrate 11 using connector sockets 13 and pin headers 15. Next, with reference to FIG. 4 to FIG. 6, an example of which the antennas 60 are disposed perpendicular to the substrate 11 will be described.

Figure 4:
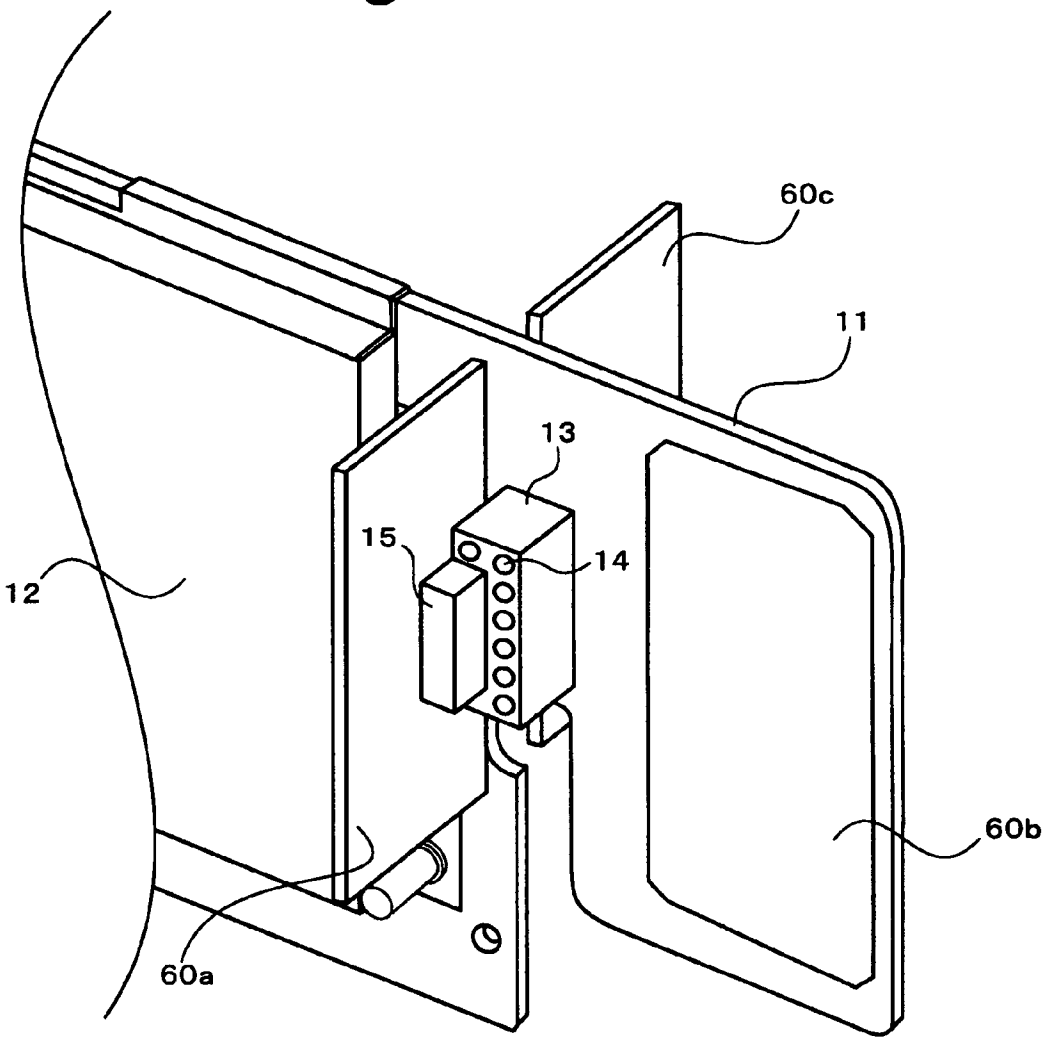
FIG. 4 is an enlarged view showing an example of a connection portion of a substrate and antennas of the antenna apparatus according to the first embodiment of the present invention.

FIG. 4 is an enlarged view showing an example of a connection portion of the substrate 11 and the antenna 60*a*. By connecting the connector socket 13 mounted on the substrate 11 and the pin header 15 mounted on the antenna 60*a*, the antenna 60*a* stands upright perpendicular to the substrate 11. By fitting holes 14 formed on the connector socket 13 facing the pin header 15 to pins 17 formed on the pin header 15 facing the connector socket 13, which is nearly rectangular parallelepiped (in FIG. 4, since the pins 17 have been inserted into the fitting holes 14, the pins 17 are not shown), the connector socket 13 and the pin header 15 are connected.

Figure 5A:
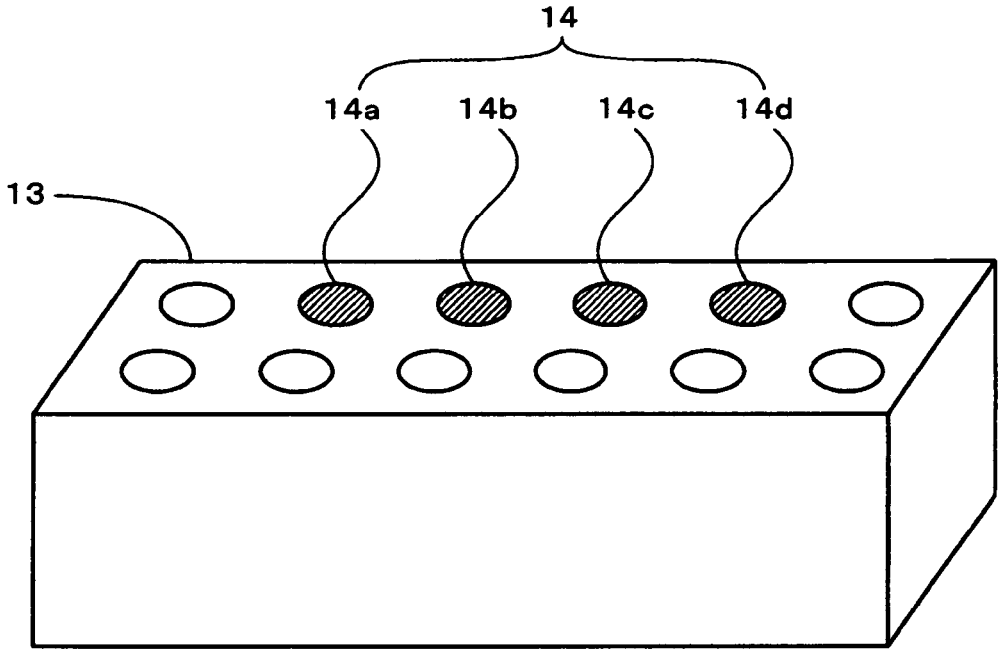
FIG. 5A and FIG. 5B are enlarged views showing a connector socket and a pin header of the antenna apparatus according to the first embodiment of the present invention.

FIG. 5A is an enlarged view showing an example of the connector socket 13. The connector socket 13 may be a general-purpose member. As shown in FIG. 5A, a plurality of fitting holes 14 are formed in the connector socket 13, facing the pin header 15. The pins 17 extruding from the pin header 15 are fit to the fitting holes 14. The number of fitting holes 14 is not limited as long as it is larger than the number of pins 17 that extrude from the pin header 15. FIG. 5A shows an example of which the number of fitting holes 14 is 12. In this example, of 12 fitting holes 14, fitting holes 14*a*, 14*b*, 14*c*, and 14*d* are used.

Figure 5B:
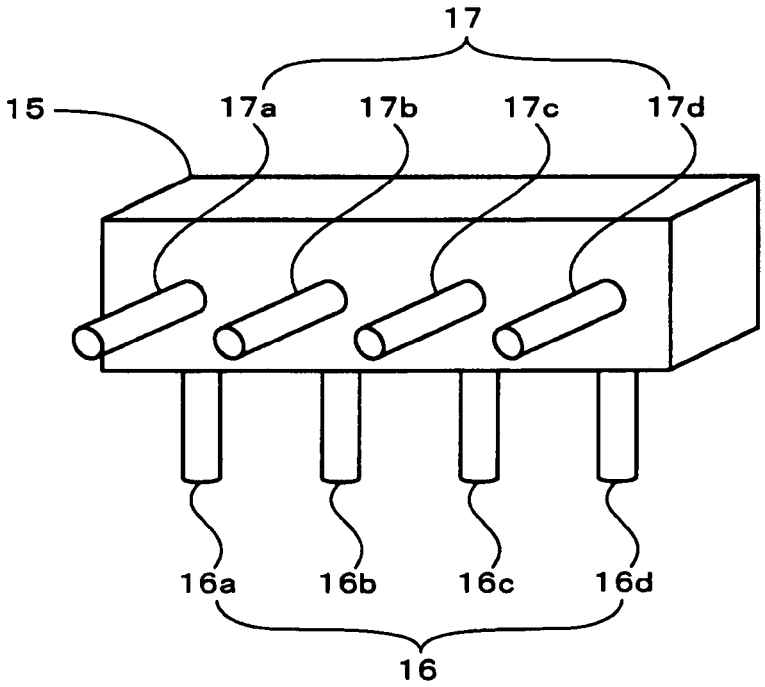

FIG. 5B is an enlarged view showing an example of the pin header 15. Like the connector socket 13, the pin header 15 may be a general-purpose member. Formed on one surface of the pin header 15 are pins 17*a*, 17*b*, 17*c*, and 17*d* (hereinafter, they are generally designated by pins 17 unless otherwise specified). The pins 17 are fit to the fitting holes 14 of the connector socket 13.

Formed on the pin header 15 are pins 16*a*, 16*b*, 16*c*, and 16*d* (hereinafter, they are generally designated by pins 16 unless otherwise specified) on a surface adjacent to the surface on which the pins 16*a*, 16*b*, 16*c*, and 16*d* are formed. The pins 16 are those that are fit and connected to through-holes of the antenna 60*a*.

The pins 16 and the pins 17 each are composed, for example, of one power supply terminal, two ground connection terminals, and one reinforcement pin. Although it is sufficient to form a total of two pins 16 connected to the antenna 60*a*, one power supply terminal and one ground terminal, if they are fit to the through-holes of the antenna 60, their fitting strength is not high. Thus, it is difficult to allow the pins 16 to stably hold the antenna 60*a* against the substrate 11 in such a manner that the antenna 60*a* is disposed perpendicular to the substrate 11. Consequently, it is preferred that the numbers of pins 16 and pins 17 be at least three each.

Figure 6A:
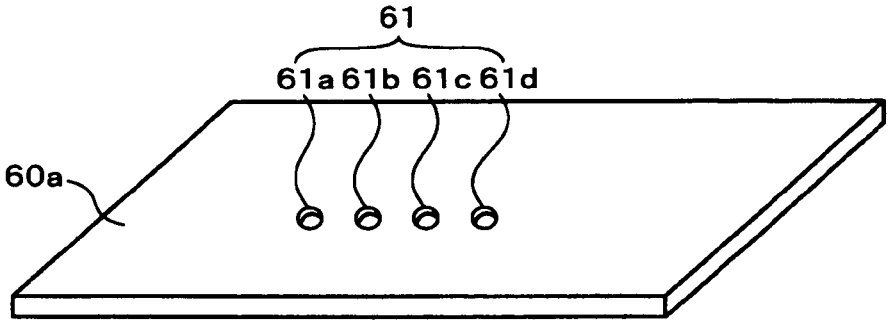
FIG. 6A, FIG. 6B, and FIG. 6C are schematic diagrams describing connections of the substrate and the pin header of the antenna apparatus according to the first embodiment of the present invention.

FIG. 6A shows the antenna 60*a* to which the pin header 15 has not yet been mounted. Formed on the antenna 60*a* are through-holes 61*a*, 61*b*, 61*c*, and 61*d* (hereinafter, they are generally designated by through-holes 61, unless otherwise specified). The number of through-holes 61 corresponds to the number of pins 16 formed on the pin header 15. In this example, four through-holes 61 are formed. The width of adjacent through-holes 61 corresponds to the width of adjacent pins 16 formed in the pin header 15.

Figure 6B:
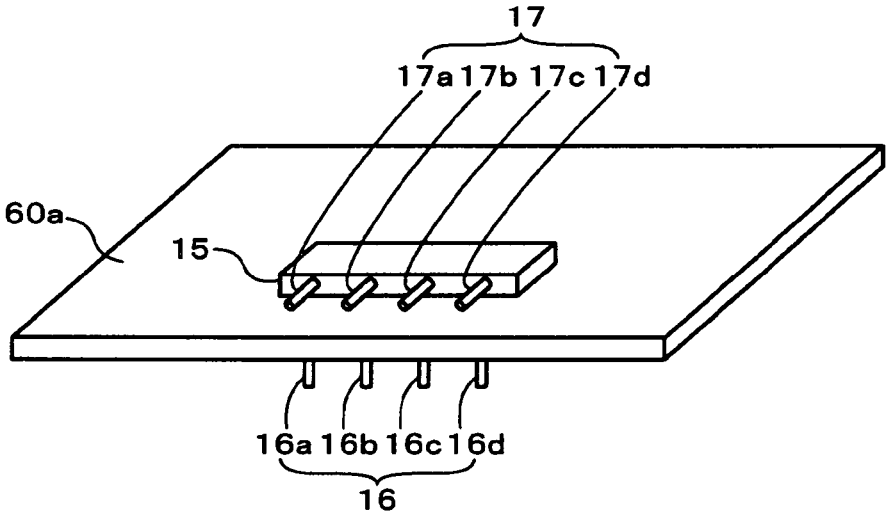
Figure 6C:
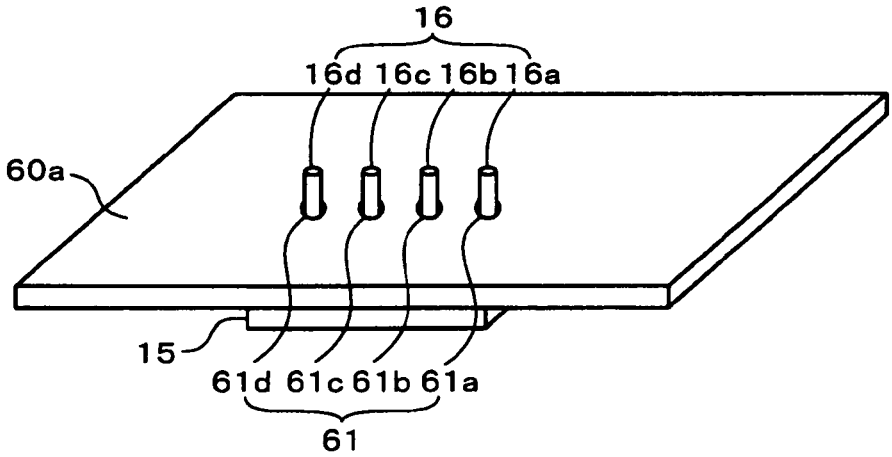

FIG. 6B and FIG. 6C show the antenna 60*a* on which the pin header 15 has been mounted. FIG. 6B is a schematic diagram showing the antenna 60*a* viewed from the pin header 15 mounted thereon. FIG. 6C is a schematic diagram showing the antenna 60*a* viewed from the pins 16 fit to the through-holes 61. As shown in FIG. 6B and FIG. 6C, by inserting the pins 16 of the pin header 15 into the through-holes 61, the antenna 60*a* and the pin header 15 are connected. The through-holes 61 and the pins 16 are individually soldered such that the antenna 60*a* and the pins 16 are more securely connected. Thus, by fitting the pins 16 of the pin header 15 to the fitting holes 14 of the connector socket 13, the antenna 60*a* is connected to the substrate 11 through the pin header 15 and the connector socket 13.

The antennas 60*c*, 60*d*, and 60*f* are connected to the substrate 11 in the same manner as that of the antenna 60*a*.

Like the antennas 60*b* and 60*e* disposed on the substrate 11, when the antenna 60 is directly connected to a power supply line on the substrate 11, matching is performed taking into account of characteristic impedance (eg, 50 ohms) of the antenna 60.

In contrast, like the antennas 60*a*, 60*c*, 60*d*, and 60*f*, when the antenna 60*a* is connected to a power supply line through the connector socket 13 and the pin header 15 on the substrate 11, matching is performed taking into account of the specific impedance of the antennas 60 and impedances of the connector socket 13 and the pin header 15.

With general-purpose connector socket 13 and pin header 15, the antenna 60*a* can be disposed perpendicular to the substrate 11 at low cost and easily.

Figure 7:
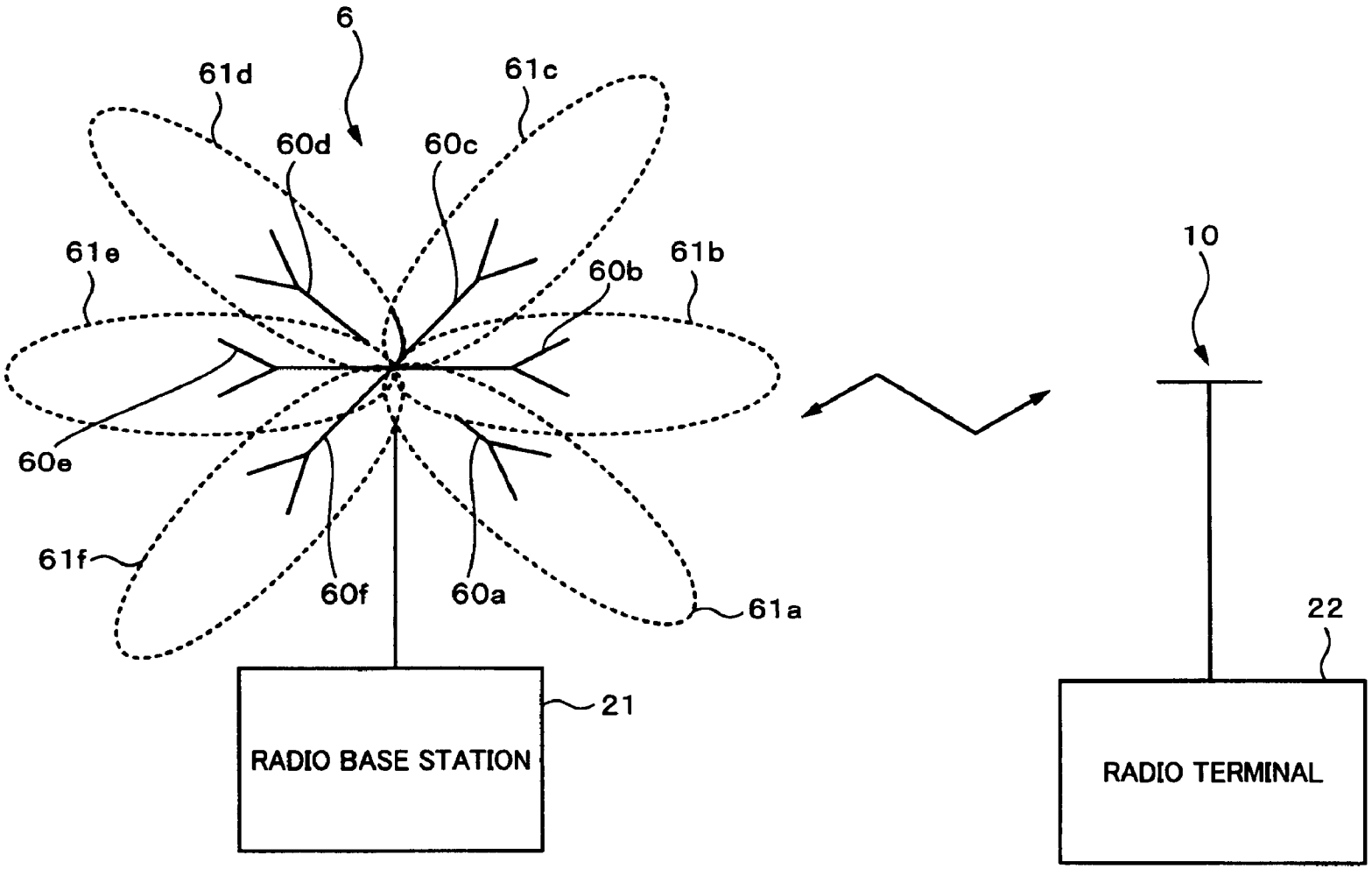
FIG. 7 is a schematic diagram showing a structure of a radio communication system composed of a radio base station and a radio terminal according to the first embodiment of the present invention.

FIG. 7 is a schematic diagram showing a structure of a radio communication system of a radio base station 21 and a radio terminal 22. As shown in FIG. 7, the antenna 60*a* has an antenna gain pattern 61*a* as its characteristic. Likewise, the antennas 60*b*, 60*c*, 60*d*, 60*e*, and 60*f* have antenna gain patterns 61*b*, 61*c*, 61*d*, 61*e*, and 61*f* as their characteristics, respectively. Thus, since the antennas 60 have antenna gain patterns that differ in their directions, directivities that nearly cover 360° can be obtained.

When data are transmitted from the radio base station 21, an antenna 60 having a higher radio condition than the others of the plurality of antennas 60 is selected by the sector antenna system. Likewise, when data are received from the radio terminal 22, an antenna 60 having a higher radio condition than the other of the plurality of antennas 60 is selected.

Figure 8:
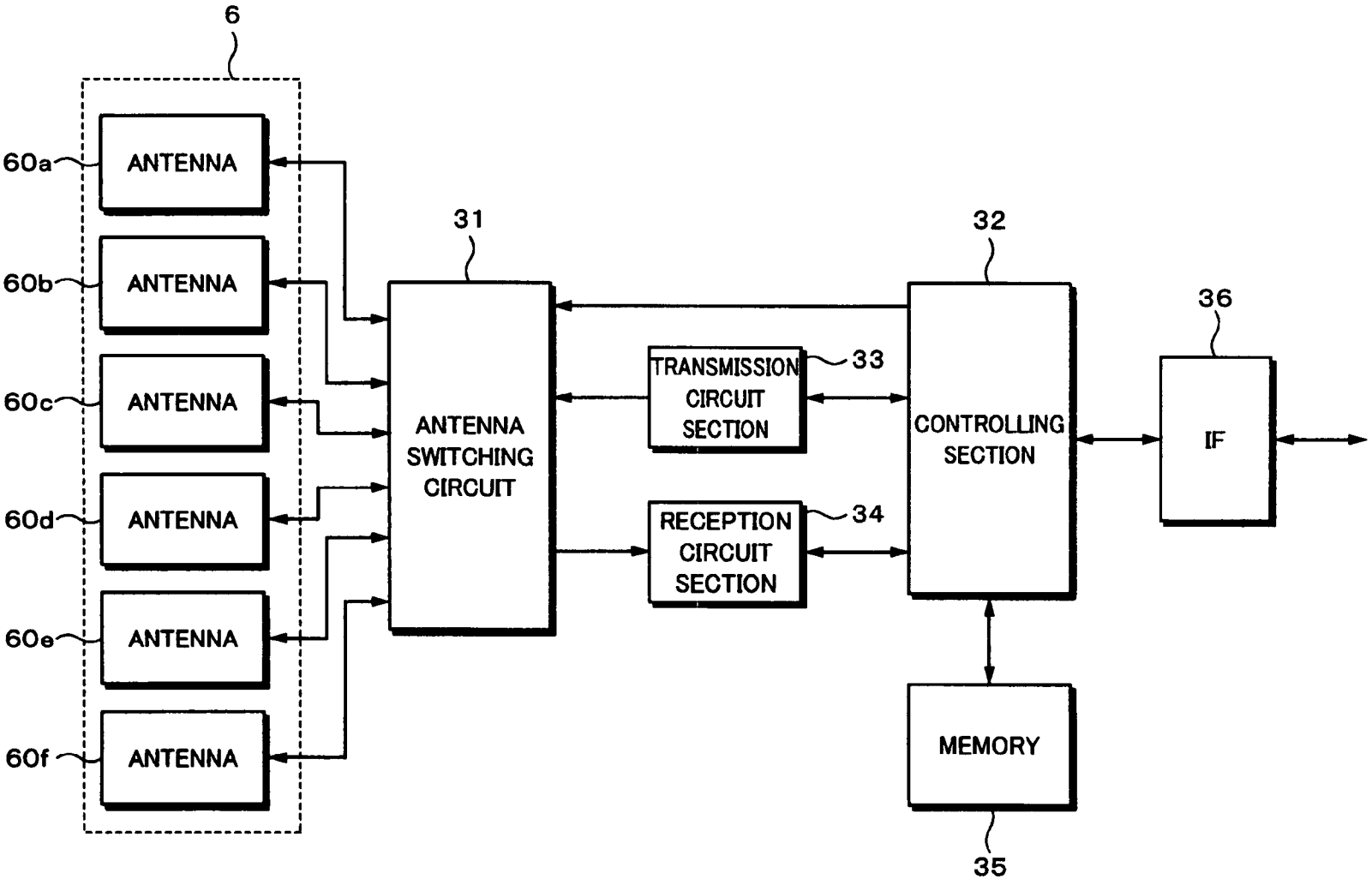
FIG. 8 is a block diagram showing an overall structure of the antenna apparatus of the radio base station according to the first embodiment of the present invention.

FIG. 8 is a block diagram showing an overall structure of an antenna apparatus of the radio base station 21 according to the first embodiment of the present invention. The antennas 60 of the radio base station 21 are switched by an antenna switching circuit 31. Through the selected antenna 60, a high frequency signal supplied from a transmission circuit section 33 through the antenna switching circuit 31 is transmitted as a radio signal. On the other hand, through the selected antenna 60, a high frequency signal of a radio signal received from the radio terminal 22 is supplied to a reception circuit section 34 via the antenna switching circuit 31.

The antenna switching circuit 31 switches between ON/OFF states of the antennas 60 according to an antenna switching signal supplied from a controlling section 32.

Supplied from the controlling section 32 to the transmission circuit section 33 is a transmission signal. The transmission circuit section 33 has a high frequency amplifying circuit, a frequency converting circuit, and so forth that convert the transmission signal into a high frequency signal and transmits the high frequency signal. The high frequency signal is transmitted from the selected antenna 60 through the antenna switching circuit 31.

Supplied to the reception circuit section 34 is a radio signal received by the antenna 60. The reception circuit section 34 has a high frequency amplifying circuit, a frequency converting circuit, an AGC circuit, and so forth receive a high frequency signal and convert it into a reception signal. The reception signal is supplied to an interface 36 through the controlling section 32.

The controlling section 32 is composed, for example, of a digital signal processor (DSP) that performs a calculating process. The controlling section 32 performs diversity control, which is a process of setting a directivity direction of an antenna 60 for the highest communication quality in radio communication with the radio terminal 22. In this process, by generating an antenna switching signal on the basis of information such as packet error rates of the antennas 60 and supplying the antenna switching signal to the antenna switching circuit 31, a directivity direction is selected. In addition, the controlling section 32 performs a process of transmitting a reference signal through the selected antenna 60 and a process of detecting a response signal corresponding to the reference signal. The reference signal is used to determine quality of communication between the radio base station 21 and the radio terminal 22. The reference signal is for example a existing communication quality determination signal or a network control signal defined in the relevant radio communication standard.

In addition, the controlling section 32 frame-segments transmission data supplied from the interface 36 and generates address information that represents a transmission recipient and a transmission sender and header information composed of various types of control information and so forth. The controlling section 32 generates a predetermined frame-formatted transmission signal from the generated header information and frame-segmented transmission data and supplies the generated transmission signal to the transmission circuit section 33.

When the reception signal is supplied from the reception circuit section 34 to the controlling section 32, it selects a self-addressed frame based on the header information and supplies a data signal contained in the selected frame as reception data to the interface 36.

Connected to the controlling section 32 is a memory 35. The memory 35 is composed of a non-volatile electrically erasable and programmable ROM (EEPROM). The memory 35 stores a program that causes the controlling section 32 to execute a control operation, information necessary for radio communication, and information such as a packet error rates that represent radio conditions of individual antennas.

Next, the radio communication operation of the radio base station 21 will be described. When the operation of the radio base station 21 is started, the controlling section 32 selects an antenna having a higher success rate based on information such as packet error rates of individual antennas 60, for example, stored in the memory 35 and supplies an antenna switching signal to the antenna switching circuit 31. The antenna switching circuit 31 switches among the antennas 60 according to the supplied antenna switching signal. Through the selected antenna 60, the reference signal is transmitted.

Thereafter, the controlling section 32 determines whether or not through the selected antenna 60 a response signal corresponding to the reference signal has been received from the radio terminal 22. When the response signal has been received from the radio terminal 22, the controlling section 32 correlates the radio base station 21 with the radio terminal 22 on a one-to-one basis (this operation is referred to as pairing). Pairing means that identification information of the substrate 11 and that of the radio base station 21 are exchanged. As identification information, ID such as a message authentication code (MAC) address, an address generated by an MAC address, or the like is used. If the controlling section 32 has not received the response signal from the radio terminal 22, the controlling section 32 selects another antenna 60 different from that through which the reference signal has been transmitted, transmits the reference signal to the radio terminal 22 through the newly selected antenna 60, and performs pairing with the radio terminal 22.

The controlling section 32 establishes a link with the radio terminal 22 using the antenna 60 through which pairing has been successfully performed. Through the established link, radio communication is made between the radio base station 21 and the radio terminal 22. If the communication condition of the selected antenna is deteriorating, the controlling section 32 switches from the current antenna 60 to another antenna 60 and performs radio communication through the newly selected antenna.

Next, with reference to FIG. 3 to FIG. 8, the structure and operation of the antenna apparatus 6 of the radio base station 21 have been described. The antenna apparatus 6 of the radio base station 21 can be applied to the antenna apparatus 10 of the radio terminal 22. In this case, the radio terminal 22 selects an antenna having a higher level of a radio signal transmitted from the radio base station 21 from the plurality of antennas, transmits a response signal corresponding to the reference signal supplied from the radio terminal 22 thereto, and establishes a link with the radio base station 21. The radio terminal 22 performs radio communication with the radio base station 21 through the established link. If the communication condition of the selected antenna is deteriorating, the radio terminal 22 selects another antenna different from the antenna that is deteriorating.

As described above, according to the first embodiment, the antenna 60*b* is disposed perpendicular to the antennas 60*a* and 60*c*. Likewise, the antenna 60*e* is disposed perpendicular to the antennas 60*d* and 60*f*. As a result, the plurality of antennas 60 can be disposed in a saved space. Thus, downsizing of the antenna apparatus 6 can be accomplished. In addition, the number of antennas 60 can be increased without necessity of increasing the size of the antenna apparatus 6. In addition, with the connector sockets 13 and pin headers 15 as general-purpose members, the antennas 60 can be disposed nearly perpendicular to the substrate 11. Since the structure of the connection portions are not complicated, the antennas 60 and the substrate 11 can be connected at low cost and easily.

Second Embodiment

A second embodiment of the present invention is an antenna apparatus having a plurality of antennas disposed perpendicular to each other. In the antenna apparatus according to the second embodiment, by combining gain patterns of individual antennas, variation of antenna gain patterns is increased. Like the first embodiment, the antenna apparatus according to the second embodiment can be used for the radio base station 21 and the radio terminal 22.

Figure 9:
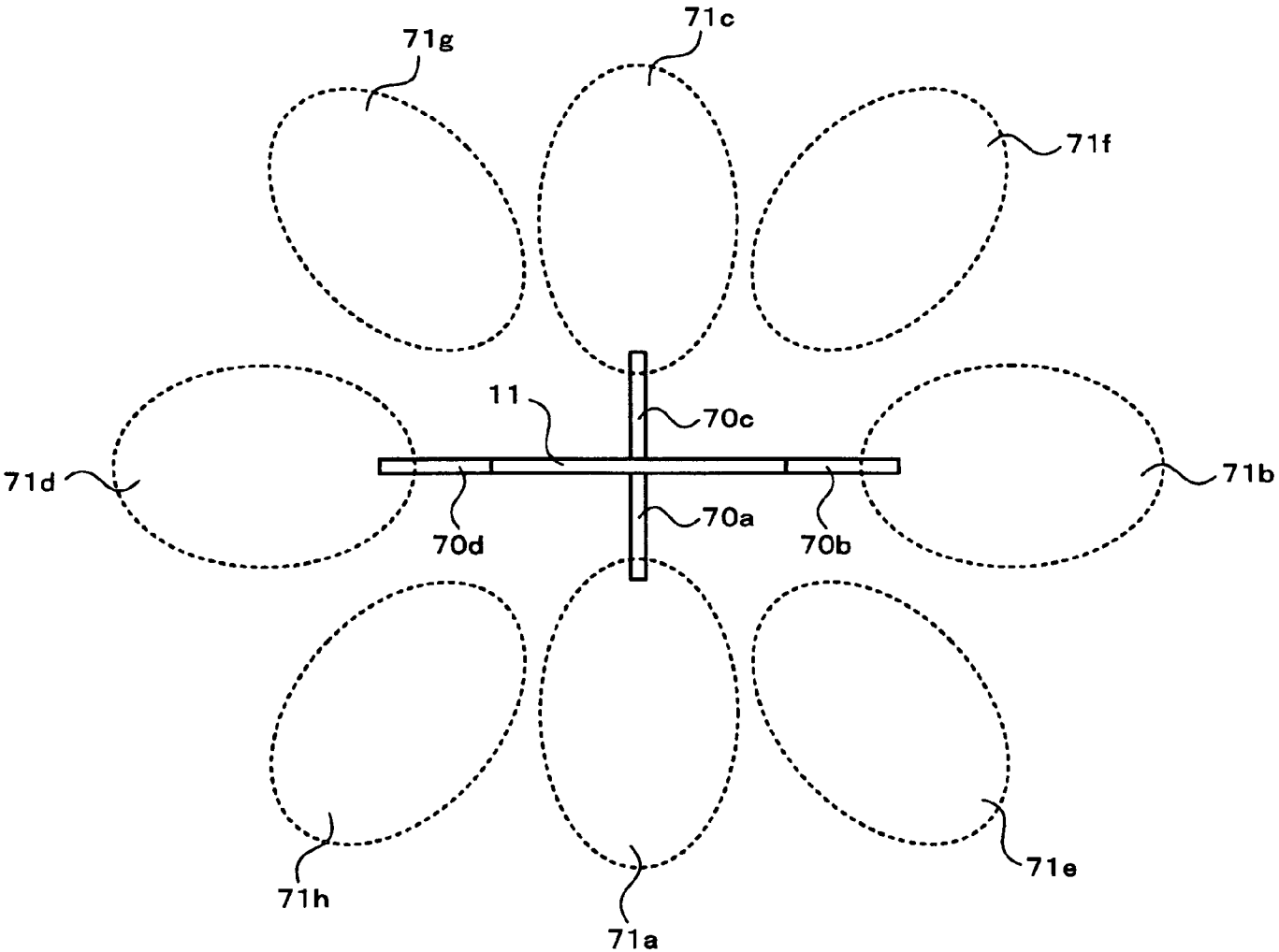
FIG. 9 is a schematic diagram showing an exemplary structure of an antenna apparatus for a radio base station and a radio terminal according to a second embodiment of the present invention.

Next, with reference to FIG. 9, the structure of the antenna apparatus according to the second embodiment will be described. FIG. 9 is a schematic diagram showing the structure of the antenna apparatus according to the second embodiment viewed from the top of the antenna apparatus in the case that principal surfaces of a substrate 11 stand upright. In the second embodiment, it is assumed that the antenna apparatus has four antennas 70*a*, 70*b*, 70*c*, and 70*d* (hereinafter, they are generally designated as antennas 70 unless otherwise specified).

The antennas 70*b* and 70*d* are disposed in parallel with the substrate 11. The antenna 70*b* is disposed at one end of the principal surfaces of the substrate 11. The antenna 70*d* is disposed on the other end of the principal surfaces of the substrate 11.

The antenna 70*a* is disposed nearly perpendicular to one principal surface of the substrate 11. On the other hand, the antenna 70*c* is disposed nearly perpendicular to the other principal surface of the substrate 11. Since the adjacent antennas 70 are disposed perpendicular thereto, they can be disposed in a saved space while their isolation is kept. Like the first embodiment, since the antennas 70*a* and 70*c* are disposed through the substrate 11, their isolation is kept with a ground layer of the substrate 11. Since the antennas 70*a* and 70*c* are connected to the substrate 11 such that the antennas 70*a* and 70*c* are perpendicular to the substrate 11 in the same manner as the first embodiment, the description will be omitted.

As shown in FIG. 9, the antenna 70*a* has an antenna gain pattern 71*a* as its characteristic. Likewise, the antenna 70*b* has an antenna gain pattern 71*b* as its characteristic. The antenna 70*c* has an antenna gain pattern 71*c* as its characteristic. The antenna 70*d* has an antenna gain pattern 71*d* as its characteristic.

In the second embodiment, by combining the antenna gain patterns 71 of adjacent antennas 70, the variation of the antenna gain patterns 71 can be increased. Specifically, by combining the antenna gain patterns 71*a* and 71*b* of the antennas 70*a* and 70*b*, an antenna gain pattern 71*e* can be obtained in a direction that is different from those of the antenna gain patterns 71*a* and 71*b*. Likewise, by combining the antenna gain patterns 71*b* and 71*c* of the antennas 70*b* and 70*c*, an antenna gain pattern 71*f* can be obtained in a direction that is different from those of the antenna gain patterns 71*b* and 71*c*. Likewise, by combining the antenna gain patterns 71*c* and 71*d* of the antennas 70*c* and 70*d*, an antenna gain pattern 71*g* can be obtained in a direction that is different from those of the antenna gain patterns 71*c* and 71*d*. Likewise, by combining the antenna gain patterns 71*d* and 71*a* of the antennas 70*d* and 70*a*, an antenna gain pattern 71*h* can be obtained in a direction that is different from those of the antenna gain patterns 71*d* and 71*a*.

Thus, in the second embodiment, in addition to the four antenna gain patterns 71 of the four antennas, by combining antenna gain patterns 71 of adjacent antennas 70, four more antenna gain patterns 71 can be obtained. Consequently, when it is necessary to dispose eight antennas in the antenna apparatus, by disposing the antennas 70 and combining the antenna gain patterns as shown in FIG. 9, the number of antennas to be disposed can be decreased and more downsizing of the antenna apparatus can be accomplished.

Figure 10:
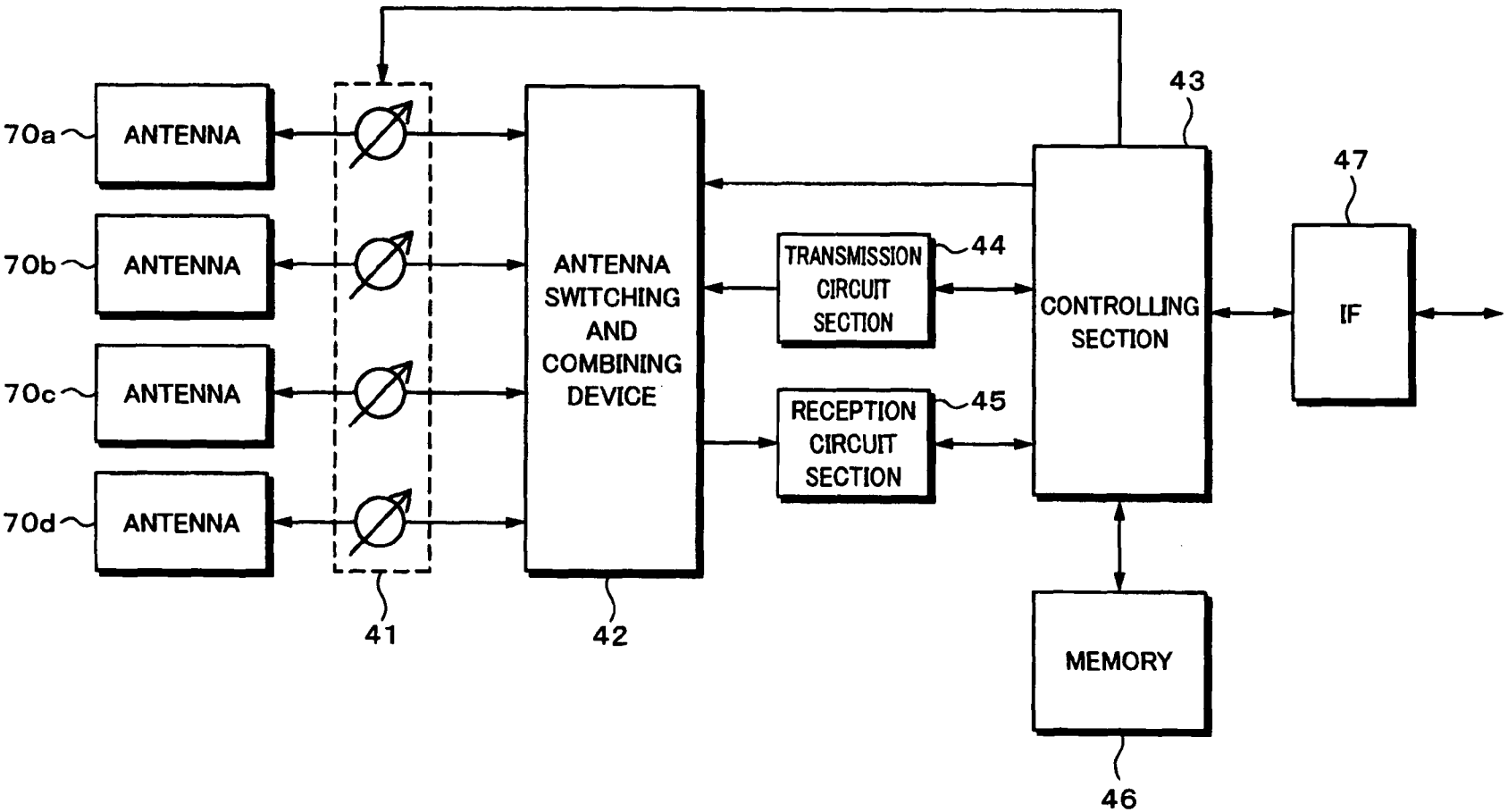
FIG. 10 is a block diagram showing an overall structure of the radio terminal according to the second embodiment of the present invention.

FIG. 10 is a block diagram showing an overall structure of the radio terminal 22 according to the second embodiment of the present invention. The antennas 70 of the radio terminal 22 are switched by an antenna switching and combining device 42 through a variable phase shifter 41 and antenna gain patterns 71 are combined. A high frequency signal is received from the radio base station 21 based on the combined antenna gain pattern 71. The received high frequency signal is supplied to a reception circuit section 45 through the variable phase shifter 41 and the antenna switching and combining device 42. On the other hand, a high frequency signal supplied from a transmission circuit section 44 through the antenna switching and combining device 42 is transmitted as a radio signal.

The variable phase shifter 41 adjusts the phases of the selected two adjacent antennas 70 according to a variable phase shifter control signal supplied from a controlling section 43. As a result, by combining the antenna gain patterns 71 of the antennas 70, a new antenna gain pattern 71 can be obtained between the adjacent antennas 70.

The antenna switching and combining device 42 switches between ON/OFF states of the antennas 70 and selects one antenna 70 according to the antenna switching signal supplied from the controlling section 43 and combines antenna gain patterns 71 of the antennas 70. The antenna gain patterns 71 of the adjacent antennas 70 are combined based on combining patterns corresponding to the selected antennas.

When the antenna 70*a* has been selected by the antenna switching and combining device 42, only the antenna gain pattern 71*a* of the antenna 70*a* is obtained. When the adjacent antennas 70*a* and 70*b* have been selected, the antenna gain patterns 71*a* and 71*b* of the adjacent antennas 70*a* and 70*b* are combined and the antenna gain pattern 71*e* is obtained. By combining antenna gain patterns 71 of adjacent antennas 70 in such a manner, eight antenna gain patterns can be obtained from four antennas 70.

Supplied from the controlling section 43 to the transmission circuit section 44 is a transmission signal. The transmission circuit section 44 has a high frequency amplifying circuit, a frequency converting circuit, and so forth that convert the transmission signal into a high frequency signal and transmit it. The high frequency signal is transmitted from the selected antenna 70 as the transmission antenna through the antenna switching and combining device 42.

Supplied to the reception circuit section 45 is a radio signal received through the antenna 70. The reception circuit section 45 has a high frequency amplifying circuit, a frequency converting circuit, an AGC circuit, and so forth that receive the radio signal as a high frequency signal and convert it to a reception signal. The reception signal is supplied to an interface 47 through the controlling section 43.

The controlling section 43 is composed, for example, of a digital signal processor that can perform a calculating process. The controlling section 43 performs diversity control, which is a process of setting a directivity direction of an antenna 70 for the highest communication quality in radio communication with the radio base station 21. If the controlling section 43 has determined that the antenna gain pattern 71*a* of the antenna 70*a* be optimum, the controlling section 43 generates an antenna switching signal corresponding to the antenna 70*a* and supplies this antenna switching signal to the antenna switching and combining device 42 to select the directivity direction. If the controlling section 43 has determined that the antenna gain pattern 71*e* of which the antenna gain pattern 71*a* of the antenna 70*a* and the antenna gain pattern 71*b* of the antenna 70*b* are combined be optimum, the controlling section 43 generates an antenna switching signal corresponding to the antennas 70*a* and 70*b* and supplies this antenna switching signal to the antenna switching and combining device 42. In addition, the controlling section 43 supplies a variable phase shifter control signal corresponding to the antenna gain patterns of the antennas 70 to be combined to the variable phase shifter 41 based on phase shifter adjustment patterns corresponding to the antennas 70 stored in a memory 46.

In addition, when the reception signal is supplied from the transmission circuit section 44 to the controlling section 43, it selects a self-addressed frame using header information and supplies a data signal contained in the selected frame as reception data to the interface 47.

In addition, the controlling section 43 frame-segments transmission data supplied from the interface 47 and generates address information that represents a transmission recipient and a transmission sensor and header information composed of various types of control information. The controlling section 43 generates a predetermined frame-formatted transmission signal using the generated header information and frame-segmented transmission data and supplies the generated transmission signal to the transmission circuit section 44. When the communication state of the reference signal received from the radio base station 21 is good, the controlling section 43 supplies a response signal corresponding to the reference signal to the transmission circuit section 44.

Connected to the controlling section 43 is the memory 46. The memory 46 is composed of a non-volatile EEPROM. The memory 46 stores a program that causes the controlling section 43 to execute a control operation, information necessary for radio communication, and information such as data of a variable phase shifter control signal. Data of the variable phase shifter control signal contain phase adjustment patterns of which antenna gain patterns 71 of antennas 70 are combined such that by combining antenna gain patterns 71 of adjacent antennas 70, an antenna gain pattern 71 of any direction can be obtained. When the antenna gain patterns 71*a* and 71*b* of the antennas 70*a* and 70*b* are combined, a phase adjustment pattern of which antenna gain patterns of antennas 70 are combined is used as a variable phase shifter control signal.

Next, with reference to FIG. 11, the structure of the antenna switching and combining device 42 will be described in detail. Although FIG. 11 shows the structure in the case that a radio signal is received with an antenna 70, the same structure can be applied to the case that a radio signal is received.

Figure 11:
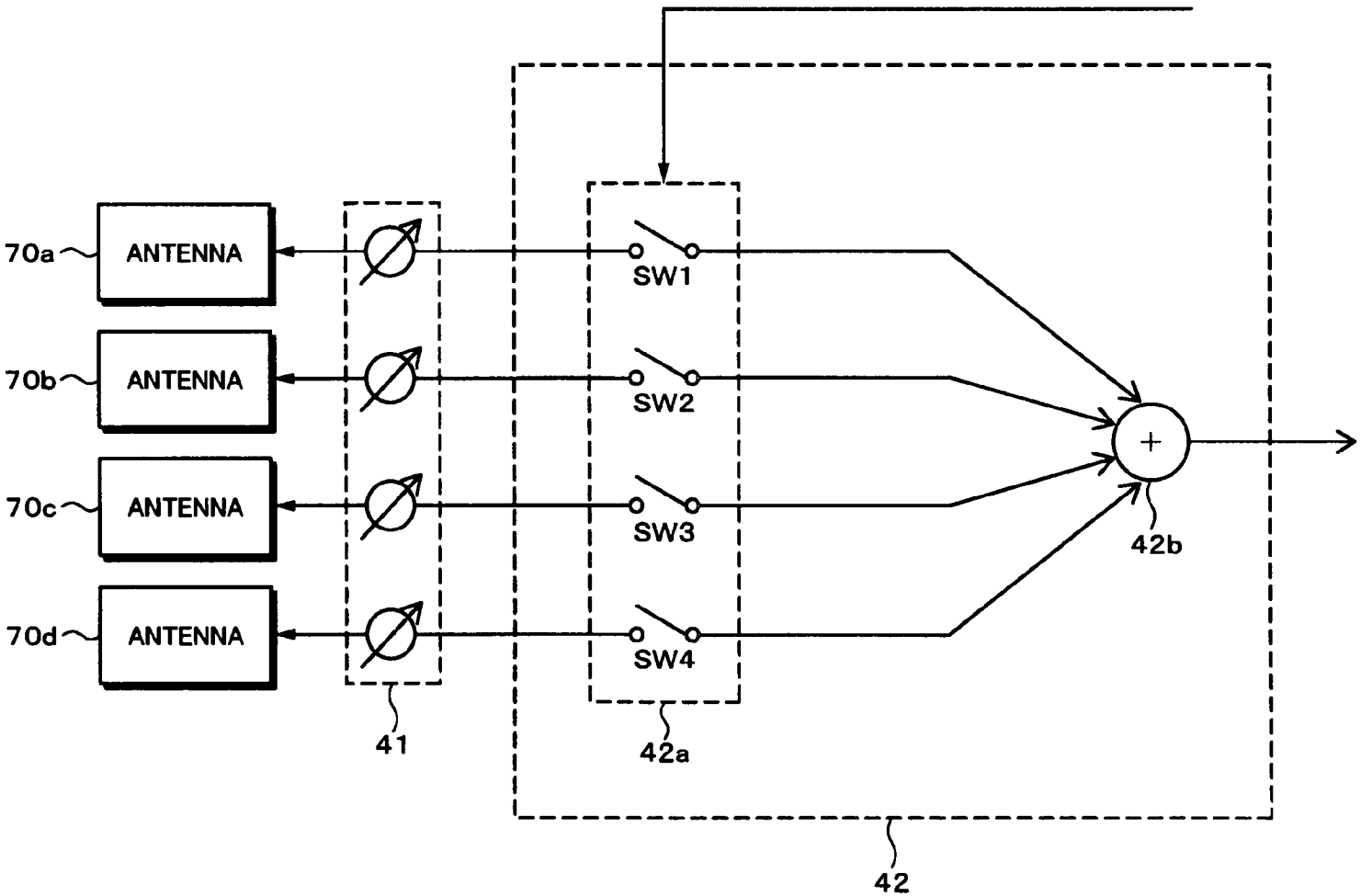
FIG. 11 is a schematic diagram showing a structure of an antenna switching and combining device of the radio terminal according to the second embodiment of the present invention.

As shown in FIG. 11, the antenna switching and combining device 42 is composed of a switching section 42*a* and an adding device 42*b*. The antenna switching and combining device 42 has switches SW1, SW2, SW3, and SW4 that are connected to the individual antennas 70. These switches SWs are turned ON/OFF according to an antenna switching signal supplied from the controlling section 43. For example, when the antenna 70*a* is selected, only SW1 is turned ON. Likewise, when the antenna 70*b* is selected, only SW2 is turned ON. When the antenna 70*c* is selected, only SW3 is turned ON. When the antenna 70*d* is selected, only SW4 is turned ON. A reception signal received by the selected antenna 70 is supplied to the reception circuit section 45 through the adding device 42*b*.

On the other hand, when adjacent two antennas 70 are selected, switches corresponding to the adjacent two antennas 70 are turned ON. For example, when the antennas 70*a* and 70*b* are selected, SW1 and SW2 are turned ON. Likewise, when the antennas 70*b* and 70*c* are selected, SW2 and SW3 are turned ON. When the antennas 70*c* and 70*d* are selected, SW3 and SW4 are turned ON. When the antennas 70*d* and 70*a* are selected, SW4 and SW1 are turned ON. The reception signals received by the selected antennas 70 are phase-adjusted by the variable phase shifter 41 and then they are added based on preset combining patterns and then supplied to the reception circuit section 45.

Next, the radio communication operation of the radio terminal 22 will be described. When the operation of the radio terminal 22 is started, the controlling section 43 determines whether or not the reference signal has been received. When the controlling section 43 has received the reception signal, the controlling section 43 selects an antenna gain pattern 71 of an antenna 70 having the highest communication quality from the antenna gain patterns 71 of the antennas 70 through which the reference signal has been received and supplies an antenna switching signal corresponding to the selected antenna gain pattern 71 to the antenna switching and combining device 42. As the communication quality of the antennas 70, for example, a measurement result of reception power, S/N, or error rate is used.

When the controlling section 43 has determined that the antenna gain pattern 71 of which those of adjacent two antennas 70 are combined be optimum, the controlling section 43 supplies an antenna switching signal to the antenna switching and combining device 42 to, select adjacent two antennas 70. In addition, the controlling section 43 supplies a variable phase shifter control signal to the variable phase shifter 41 corresponding to the antenna gain patterns 71 of the antennas 70 to be combined based on their phase shifter adjustment patterns stored in the memory 46.

Thereafter, the controlling section 43 transmits the response signal corresponding to the reference signal received from the radio base station 21 through the selected antenna 70 and performs pairing between the substrate 11 and the radio base station 21.

Thereafter, the controlling section 43 establishes a link with the radio base station 21 through the antenna 70 through which pairing has been successfully performed and performs radio communication between the radio base station 21 and the radio terminal 22 through the established link. If a communication state of the selected antenna is deteriorating, the controlling section 43 switches from the deteriorating antenna 70 to another antenna 70 and performs radio communication through the antenna 70.

When adjacent two antennas 70 are selected, the phases of the two antennas 70 are changed by the variable phase shifter 41. The phases of the antennas 70 are adjusted based on a variable phase shifter control signal supplied from the controlling section 43. Radio signals received by the adjacent antennas 70 are combined by the antenna switching and combining device 42 and then the combined signal is supplied to the reception circuit section 45.

With reference to FIG. 10, the structure of the radio terminal 22 has been described. The structure of the radio terminal 22 can be applied to the radio base station 21.

In the second embodiment, by combining antenna gain patterns of adjacent antennas 70, a new antenna gain pattern different from those of the antennas 70 can be obtained. In other words, since the number of antenna gain patterns that is larger than the number of antennas can be obtained, the number of antennas mounted on the antenna apparatus can be decreased. Thus, the antenna apparatus can be more downsized.

Although the first and second embodiments of the present invention were described, it should be understood by those skilled in the art that various modifications, combinations, sub-combinations and alternations may occur depending on design requirements and other factors insofar as they are within the scope of the appended claims or the equivalents thereof. For example, diversity control according to embodiments of the present invention may be applied to wireless LAN systems other than LocationFree.

The number of antennas of the antenna apparatus of the foregoing first and second embodiments are just exemplary. In other words, the number of antennas disposed on the antenna apparatus is not limited to a specific number.

What is claimed is:

1. An antenna apparatus, comprising:

a first antenna, a second antenna, and a third antenna which have different directivity directions from each other and which are switched for a desired directivity direction, wherein the first antenna is disposed on an end of principal surfaces of a substantially planar substrate in parallel with the principal surfaces of the substrate, wherein the second antenna is disposed on one principal surface of the principal surfaces of the substrate substantially perpendicular to the one principal surface, wherein the third antenna is disposed on the other principal surface of the principal surfaces of the substrate substantially perpendicular to the other principal surface.

2. The antenna apparatus as set forth in claim 1, wherein by combining gain patterns of adjacent two antennas of the first antenna, the second antenna, and the third antenna, a fourth antenna pattern is obtained in a direction different from a first antenna gain pattern obtained from the first antenna, a second antenna gain pattern obtained from the second antenna, and a third antenna gain pattern obtained from the third antenna.

3. The antenna apparatus as set forth in claim 1, wherein a connector socket is mounted on the substrate, wherein pin headers are mounted on the second antenna and the third antenna, and wherein by fitting the pin headers to the connector socket, the second antenna and the third antenna are nearly perpendicularly connected, respectively, to the one principal surface and the other principal substrate.

4. The antenna apparatus as set forth in claim 3, wherein the pin header has at least three pins and the at least three pins are fit to the connector socket.

* * * * *